United States Patent [19]

Hemphill, Sr. et al.

[11] Patent Number: 4,776,114

[45] Date of Patent: Oct. 11, 1988

[54] TEETH ON A TOOTH

[76] Inventors: Charles W. Hemphill, Sr., 1106 Green Valley La., Duncanville, Tex. 75137; Charles W. Hemphill, Jr., 6211 Fox Run, Arlington, Tex. 76016; James K. Hemphill, 18009 Saddlehorn, Mansfield, Tex. 76063

[21] Appl. No.: 40,211

[22] Filed: Apr. 15, 1987

[51] Int. Cl.[4] ..... E02F 3/08

[52] U.S. Cl. ..... 37/191 A; 37/86; 37/192 A

[58] Field of Search ..... 37/191 A, 191 R, 192 A, 37/192 R, 83–90, 141 T, 142 R, 189; 175/89, 90; 299/82, 83, 88, 79

[56] References Cited

U.S. PATENT DOCUMENTS

| | | | |
|---|---|---|---|
| 1,210,453 | 1/1917 | French | 37/90 |
| 1,333,852 | 3/1920 | Kittredge | 37/141 T |
| 1,419,524 | 6/1922 | Seyms | 37/141 T |
| 1,908,883 | 5/1933 | Black . | |
| 2,669,792 | 2/1954 | Hein | 37/191 R |
| 2,965,989 | 12/1960 | Hibbard | 37/143 |
| 3,050,881 | 8/1962 | Brown | 37/191 A |
| 3,286,379 | 11/1966 | Benetti | 37/142 |
| 3,307,277 | 3/1967 | Kondracki | 37/141 |
| 3,497,973 | 3/1970 | Campbell | 37/141 |
| 3,531,161 | 9/1970 | Conn | 299/18 |
| 3,841,709 | 10/1974 | Kniff | 299/88 |
| 4,158,924 | 6/1979 | Brown | 37/191 A X |

*Primary Examiner*—Paul T. Sewell
*Assistant Examiner*—James Lisehora
*Attorney, Agent, or Firm*—Marcus L. Bates

[57] ABSTRACT

A unitary digging tooth is removably mounted to an excavating machine. The tooth has a cutting face formed at a working end which is opposed to a trailing end thereof. An upper end of the tooth is removably attached to the excavating machine. A plurality of discrete teeth are made integral with and extend forward of the cutting edge. The upper marginal end of the tooth is relatively flat, and the lower marginal end of the tooth is a segment of a cone, and therefore curves when viewed in lateral cross-section. The individual teeth are spaced apart, and arranged parallel to one another, and form part of a digging face at the forward end of the tooth. The tooth is oriented in a vertical plane.

19 Claims, 3 Drawing Sheets

FIG. 1
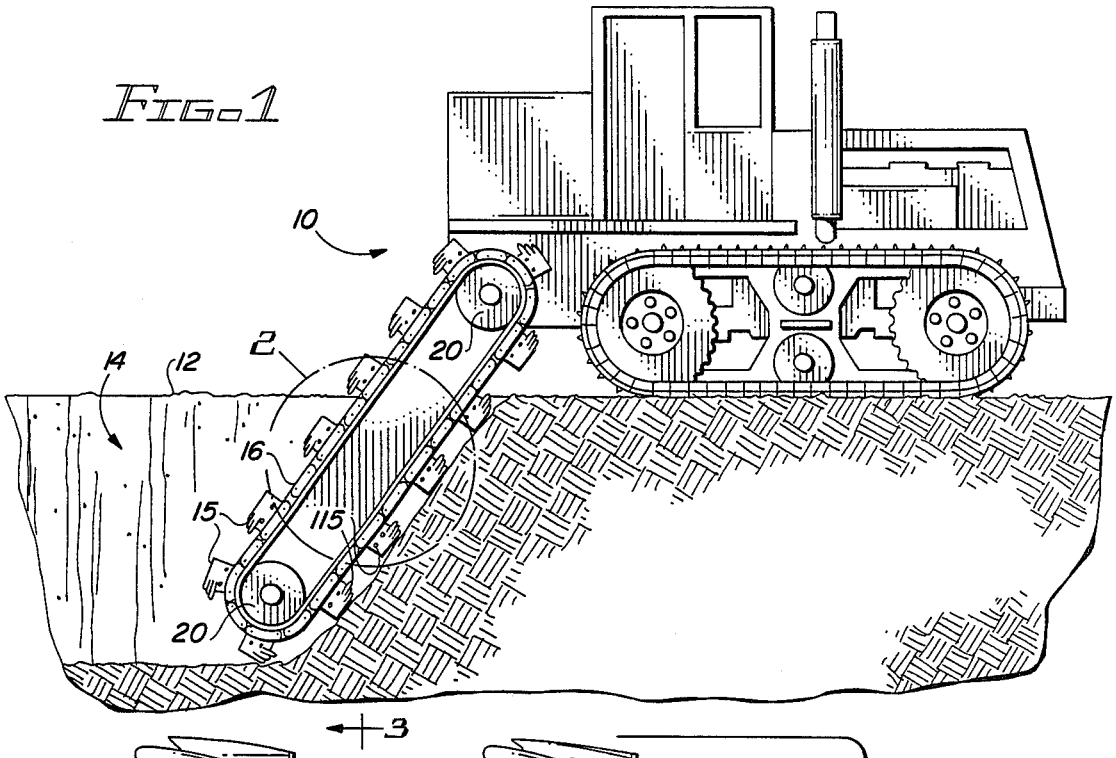
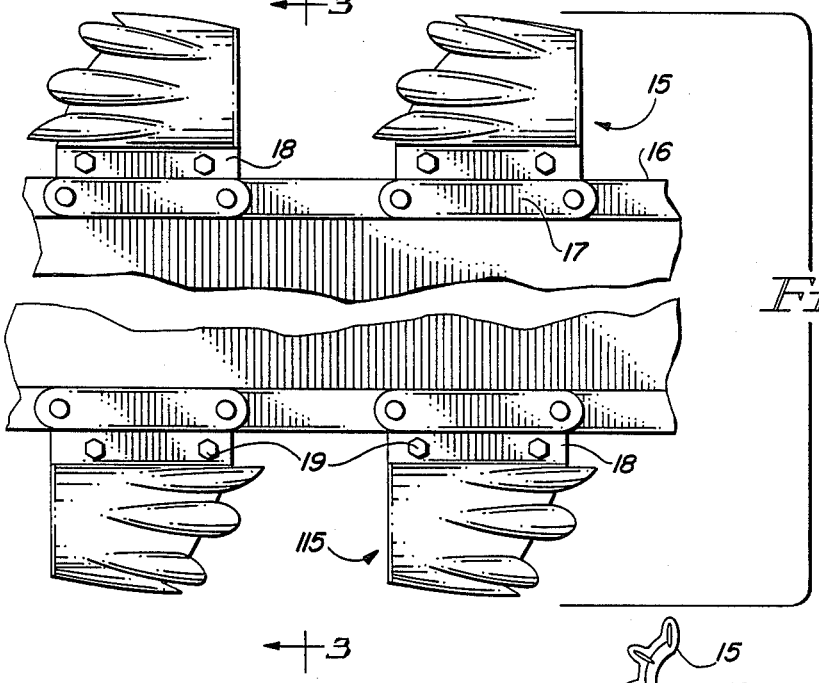
FIG. 2
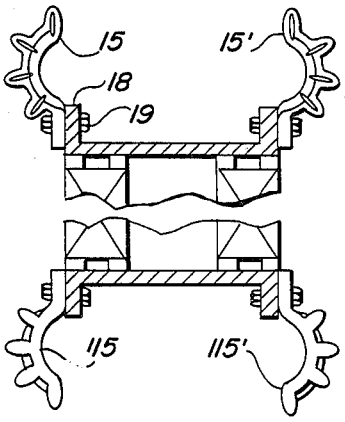
FIG. 3

TEETH ON A TOOTH

BACKGROUND OF THE INVENTION

Teeth which are cylindrical in form are known to those skilled in the art, as evidenced by my previous U.S. Pat. No. 4,476,642. In this patent, the teeth have a shank trailing therebehind which is received within a complementary shaped pocket of a holder by which the tooth is mounted to an excavating machine.

Digging teeth which have an upper, relatively flat portion and a lower portion which is circular, in lateral cross-section are known to those skilled in the art. This particular digging tooth is made from a flat piece of metal which is bent into a curved configuration and provided with a sharp cutting edge at the leading end thereof. The tooth is made for digging in soft formations as contrasted to hard formations. This type of tooth presents a large frontal area to the ground and accordingly, requires a considerable amount of horsepower in order to force the tooth to move through the ground with a digging action. As the cutting edge of the tooth is abraded away and lost, the horsepower required by the excavating machine increases until eventually the tooth must be replaced. Sometime hard surfacing is placed on the tooth in order to lengthen its service life.

It would be advantageous to further reduce the power consumption required to move a digging tooth such as described above through the ground with a digging action. It would be especially advantageous to improve the tooth so that it could dig in hard formations. This is the subject of the present invention.

SUMMARY OF THE INVENTION

A digging tooth is made of unitary construction and provided with a plurality of smaller digging teeth which dig in advance of the cutting edge. In the preferred form of the invention, the digging tooth is cast using a special alloy metal. The upper marginal end of the tooth is flat and apertured to provide mount means by which the tooth is removably mounted to an excavating machine. The lower marginal end of the tooth is a segment of a circle in lateral cross-section. The forward end of the tooth has a cutting edge formed thereon, and a plurality of discrete digging members are integrally affixed to the tooth and extend forward of the cutting edge. The individual digging members are substantially parallel to one another and aligned longitudinally respective to digging movement of the tooth.

In one form of the invention, the tooth, when viewed from the side, has the cutting edge thereof arranged at an angle whereby the upper end of the cutting edge engages the ground in advance of the lower end thereof. The uppermost of the plurality of individual digging members is mounted in advance of the lowermost digging member. The individual digging members have a trailing marginal end which merge into the main cylindrical or conical body of the tooth.

In one form of the invention, the individual digging members have a longitudinally extending recess formed therein which further reduces the cross-sectional area or thickness of the tooth. This enables the tooth to efficiently dig in soft ground.

The tooth of the present invention therefore presents a plurality of digging members in advance of the cutting edge of the tooth and thereby increases the digging efficiency of the tooth. The uppermost digging member removes material in advance of the next adjacent digging member, thereby sequentially reducing the load placed on each of the digging members. The cooperative action between the individual digging members brings about an unexpected digging advantage. The cooperative action between the individual digging members and the cutting edge of the tooth also brings about unexpected advantages in a digging tooth. When both of these advantages are used, the result is an improved digging tooth that excavates material with an efficiency heretofore unrealized by ordinary, commercially available digging teeth.

The digging tooth of the present invention can be arranged respective to other identical digging teeth and other digging teeth which are mirror images thereof in order to provide a pattern of similar digging teeth arranged to excavate various different widths of ditches. The size of the digging tooth can be scaled up or down as may be required to accommodate any digging machine.

Accordingly, a primary object of the present invention is the provision of an improved digging tooth having a ground engaging end which is curved in lateral cross-section, and which includes a plurality of ground engaging members thereon.

Another object of the present invention is the provision of an improved digging tooth of unitary construction having a curved cutting edge at the leading end thereof which is a segment of a circle and arranged in a vertical plane, with there being a plurality of ground engaging members extending in advance of the cutting edge.

A further object of the present invention is the provision of a digging tooth having an inclined cutting edge at the leading end thereof, a plurality of excavating members extending forwardly of the cutting edge, with both the cutting edge and the individual excavating members being arranged whereby the upper ground engaging member contacts and excavates the ground in advance of the next adjacent ground engaging member.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

BRIEF DESCRIPTION OF THE DRAWINGS

FIG. 1 is a part schematical, part diagrammatical, part cross-sectional, side view of an excavating machine having digging teeth associated therewith made in accordance with the present invention;

FIG. 2 is an enlarged, broken, detailed, side elevational view of part of the digging apparatus disclosed in FIG. 1;

FIG. 3 is a cross-sectional view taken along line 3—3 of the apparatus desclosed in FIG. 2;

DETAILED DESCRIPTION OF THE PREFERRED EMBODIMENT

Figure 4:
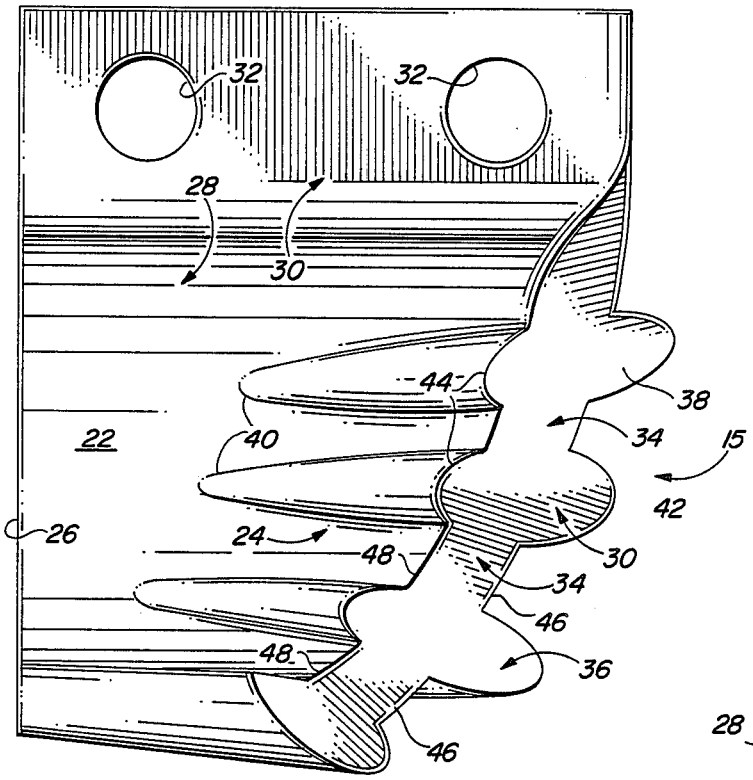
FIG. 4 is a further enlarged, side elevational view of a digging tooth made in accordance with the present invention.
Figure 5:
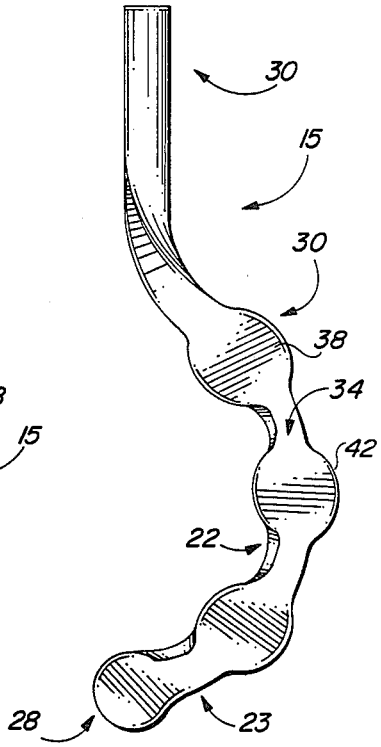
FIG. 5 is a front, elevational view of the digging tooth disclosed in FIG. 4.
Figure 6:
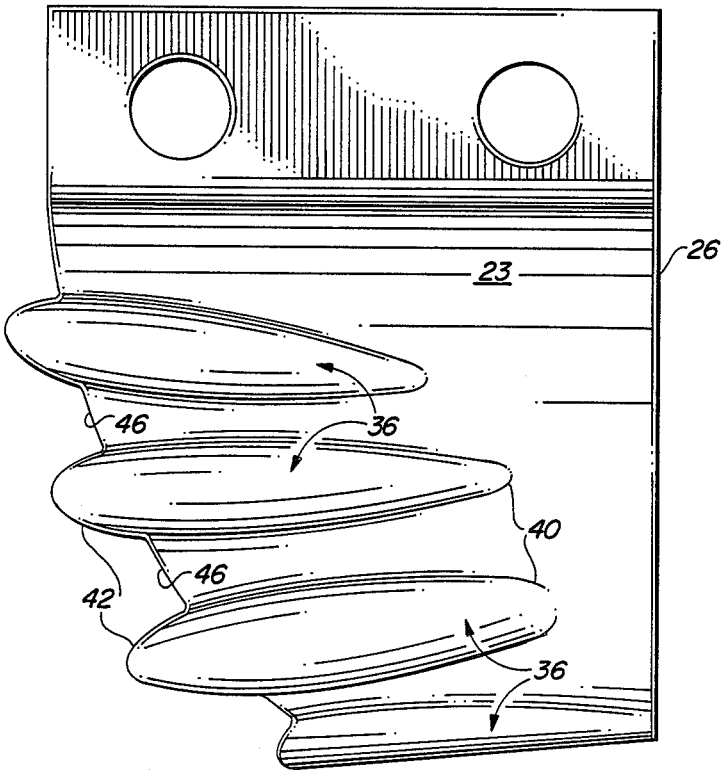
FIG. 6 is a side elevational view of the opposed side of the digging tooth disclosed in FIG. 4.
Figure 7:
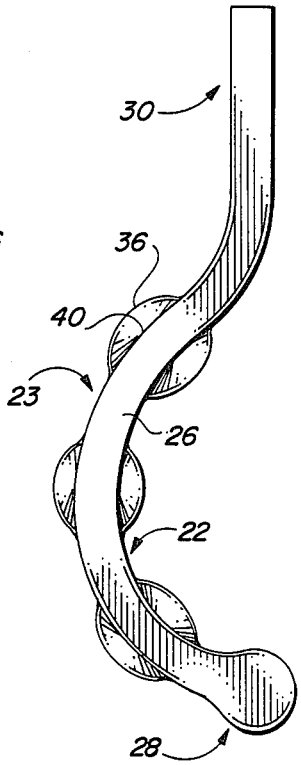
FIG. 7 is a rear view of the digging tooth disclosed in FIG. 4.

In FIG. 1 of the drawings, there is disclosed an excavating machine 10 for excavating material from the ground 12, and thereby form a ditch 14. The excavating machine includes a plurality of teeth 15 mounted to any suitable apparatus 16 by which the tooth can be satisfactorily moved respective to the ground 12. As seen in FIG. 1, there is an upper run of teeth 15 and a lower run of teeth 115 attached to an endless chain mounted on spaced rotatable sprockets 20.

In FIG. 2, the endless chain 16 comprises a number of adjacent links 17 to which there is attached a tooth receiving pad 18. Bolts 19 removably attach the teeth 15, 115 to the pad 18 which is secured to the links 17.

As seen in FIG. 3, some of the teeth 15' are mirror images of the tooth 15 so that teeth can be placed in confronting relationship at various spaced apart intervals along the endless chain to thereby provide various different desirable digging patterns with the excavating machine 10.

FIGS. 4–7 illustrate the preferred form of a digging tooth 15 for use with excavating apparatus, such as seen, for example, in FIG. 1. In FIG. 4, together with FIGS. 5–7, the digging tooth 15 is of unitary construction and is adapted to be removably mounted to an excavating machine as seen in FIG. 1, for example. The tooth 15 has a main body formed by inner and outer surfaces 22 and 23, respectively. The main body has a forward working part 24 opposed to a trailing end 26. The tooth 15 has a lower curved digging part 28 opposed to an upper flat mounting part 30, and means 32 for mounting said tooth 15 for digging movement respective to the excavating machine.

The forward working part 24 of the tooth has a first curved cutting edge shown as cutting face 34 formed thereon. A plurality of discrete digging members 36 are integrally affixed to the main body and include a cutting face 38 which extends forwardly of said cutting face 34. The digging members 36 therefore individually engage the ground in advance of the cutting edge 34.

The upper part 30 of the tooth is substantially flat and mounting holes 32 provide the means by which the tooth 15 can be suitably mounted to a digging apparatus. The lower part 28 of the tooth is a segment of a cone; it is curved into a segment of a circle when viewed in lateral cross-section. The forward working part 24 of the tooth is located on the lower part 28.

The forward working part 24 of the tooth 15 is forwardly and upwardly inclined. Each of the digging members 36 are arranged in stair-stepped relationship respective to one another, with the uppermost digging member being located to engage the ground in advance of the next adjacent digging member. Each of the digging members 36 are arranged almost parallel to one another. The cutting face 38 of each digging member 36 has a forward cutting edge 42 which terminates at rear edge 44, while the trailing end 40 thereof merges with the curved surfaces 22 and 23 of the lower part 28. The cutting face 34 located between the cutting faces 38 include a leading sharp edge 46 and a trailing edge 48. The cutting faces 34 and 38 merge together into a continuous face which extends in advance of the face 34 at 42 and to the rear at 44.

Figure 9:
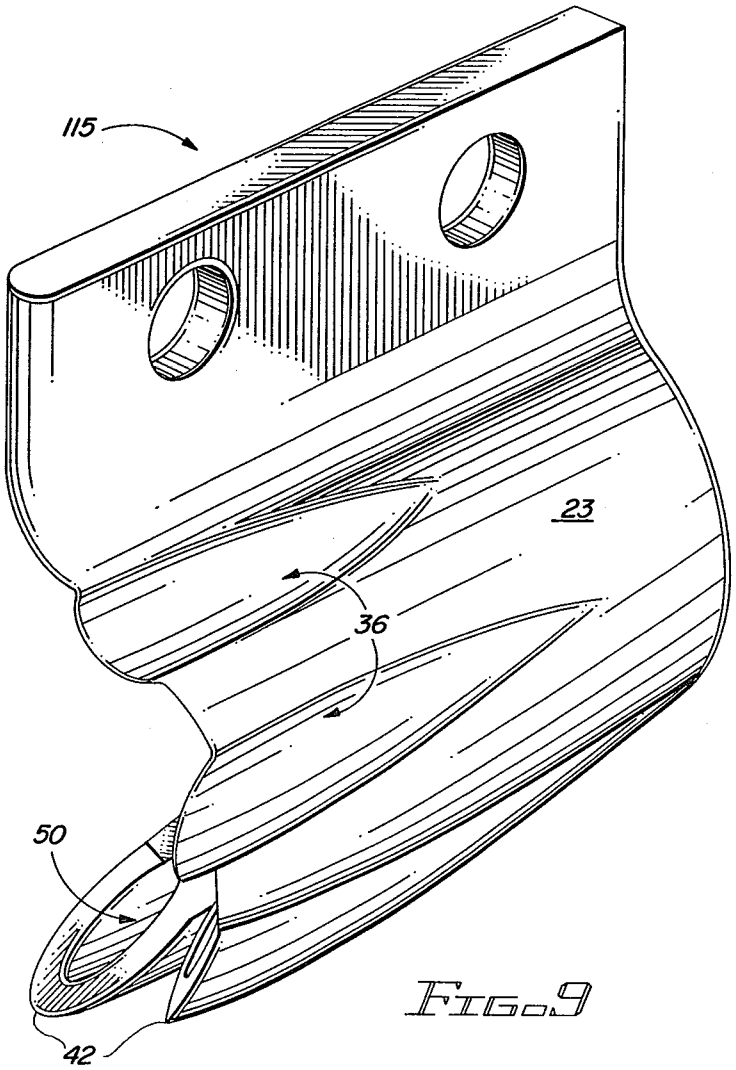
Figure 8:
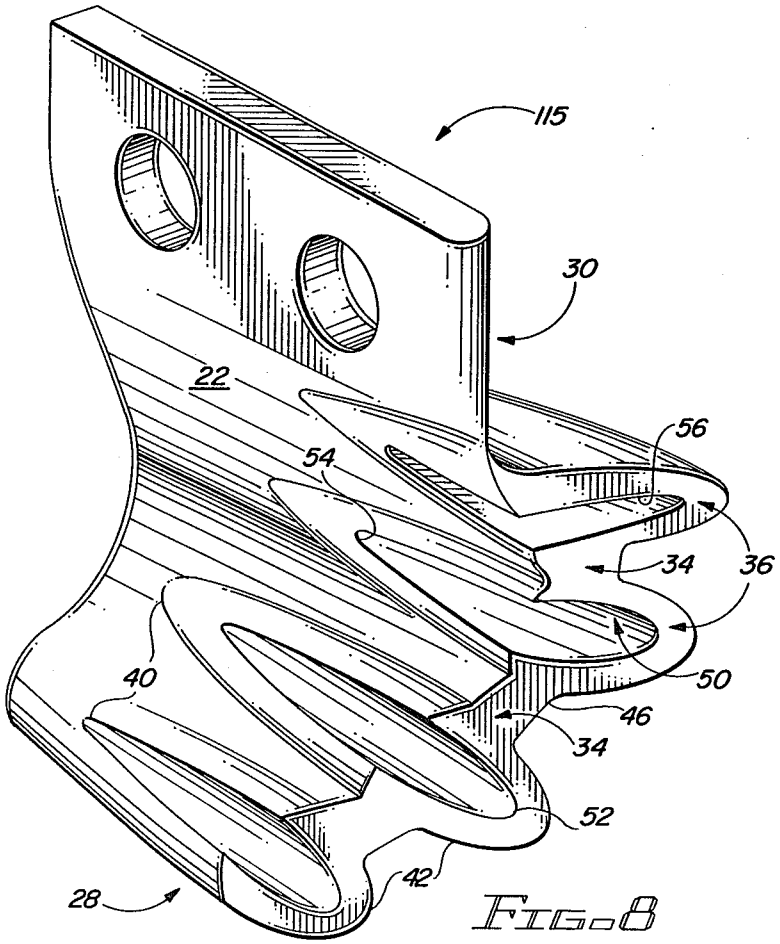
FIG. 8 is a perspective, front view of another embodiment of the digging tooth disclosed in FIG. 4; and, FIG. 9 is a perspective view of the other side of the digging tooth disclosed in FIG. 8.

In the second embodiment 115 of the invention set forth in FIGS. 8 and 9, each of the digging members 36 has a longitudinally extending relief 50 formed therein that reduces the thickness of the member 36 and enables the entire digging tooth to be forced through the ground with reduced power, and facilitates digging in relative soft formations.

The relief 50 is arranged longitudinally of the digging members 36, and commences at 52 at the cutting face 38 and terminates at 54 in spaced relationship respective to the end 40 of the digging member 36.

An important and novel aspect of the present invention is the provision of a digging tooth having a main body in the form of a segment of a cone. A plurality of digging members 36 is arranged on the digging tooth 15 in advance of a cutting edge 34. The individual digging members 36 are positioned in stair-stepped relationship respective to one another, and the cutting edge 34 is inclined downwardly and away from the direction of movement of the tooth 15; whereby, the uppermost digging member engages the ground in advance of the next adjacent digging member and in advance of the cutting edge. This action reduces the power consumption required to force the cutting edge of the tooth through the ground, and provides unexpected advantages heretofore unrealized with other known digging teeth.

The inclination of the cutting edges 34 and 38 so that it is raked downward towards the rear causes excavated material to be removed at the top of the ditch in advance of the lower part thereof, thereby easing the force required for moving the tooth with a digging action. Moreover, another important and novel aspect of the invention is the provision of the digging members 36 arranged in advance of the cutting edge 34 which further reduces the power required to force the tooth through the ground. This unusual arrangement of the digging members and cutting edge provides a new digging tooth that is superior to comparable digging teeth of the prior art.

In each embodiment of the tooth, the lower part 28 is a segment of a frustum of a conical annulus. The digging members 36 are not quite parallel to one another and would meet at a common point if extended rearwardly a sufficient distance. The digging members each have a thickness or diameter at the leading end thereof which is substantially larger than the thickness measured between the sidewalls 22 and 23. The individual digging members 36 are conical structures having a cutting face 38 formed by an oblique plane. The other end of the conical structure merges at 40 into sidewalls 22 and 23 of the main body.

We claim:

1. A digging tooth of unitary construction for an excavating machine; said tooth having a main body, said main body having a forward working part and a trailing end opposed to said forward working part; and, an upper flat part, a lower curved part opposed to said upper flat part;

means mounting said upper flat part of said main body on an excavating machine for digging movement respective to the ground;

said forward working part terminating in a first curved cutting edge, a plurality of discrete digging members integrally affixed to said main body and extending forwardly of said first cutting edge and terminating in a cutting face; said cutting face and said first cutting edge jointly presenting a continuous cutting member that extends from the lowermost part of the tooth up to said upper flat part;

said cutting face of said digging members having a cutting edge that engages the ground in advance of said first cutting edge;

said digging members being circular in lateral cross-section and of gradually reduced diameter rearwardly to merge into said main body.

2. The digging tooth of claim 1 wherein said upper flat part of said tooth includes said mounting means; said lower curved part of said tooth is in the form of a segment of a cone and forms part of a circle when viewed in lateral cross-section, said forward working part of said tooth being the forward marginal end of said lower curved part.

3. The digging tooth of claim 2 wherein said lower curved part of said tooth is forwardly and upwardly inclined at said forward working part, thereby arranging each of the digging members in a stair-stepped relationship with the uppermost digging member being located in advance of the lowermost digging member.

4. The digging tooth of claim 3 wherein the forward end of said digging members are of a diameter greater than the thickness of said lower curved part, said digging members are reduced in diameter towards the rear of the tooth to a thickness equal to said lower curved part, each of the digging members are arranged with the longitudinal axis thereof to intersect at a point rearwardly of the forward part of the tooth, whereby each digging member terminates in a cutting face at the forward end thereof, and merges into the main body at the trailing end thereof.

5. The digging tooth of claim 1 wherein said upper part of said tooth is substantially flat and includes said mounting means;

said lower part of said tooth being a segment of a curve in lateral cross-section, said forward working part of said tooth being located on said lower part;

said lower part of said tooth being forwardly and upwardly inclined at said forward working part, each of the digging members are arranged in a stair-stepped relationship with the uppermost digging member being located in advance of the lowermost digging member.

6. The digging tooth of claim 5 wherein each of said digging members are arranged substantially parallel to one another, each digging member terminating in a cutting face.

7. The digging tooth of claim 6 wherein each digging member has a longitudinally extending relief formed therein that reduces the thickness of the member.

8. A digging tooth having upper and lower ends, mounting means at said upper end thereof, said lower end having a forward working end and an opposed to a trailing end opposed sidewalls;

the lower end of said tooth being curved to present a curved structure when viewed in lateral cross-section;

said forward working end terminating in a cutting edge; a plurality of spaced digging members integrally attached to said lower end and extending forwardly of said forward cutting edge; said upper part of said tooth being substantially flat and including said mounting means; said lower end of said tooth being a segment of a cone, said forward working end of said tooth being located on said lower end.

9. The digging tooth of claim 8 wherein each of said digging members are arranged in spaced relationship respective to one another, each digging member terminating in a cutting face at the forward end thereof, and merging into said lower end at the trailing end thereof;

whereby; there is formed a continuous cutting edge from said mount means to said lower end of the tooth.

10. The digging tooth of claim 8 wherein said lower end of said tooth is forwardly and upwardly inclined at said forward working end, thereby arranging each of the digging members in a stair-stepped relationship with the uppermost digging member being located in advance of the lowermost digging member.

11. The digging tooth of claim 10 wherein each of said digging members are arranged in spaced relationship respective to one another, each digging member terminating in a cutting face at the forward end thereof, and merging into said lower end at the trailing end thereof.

12. The digging tooth of claim 8 wherein said upper end of said tooth is substantially flat and includes said mounting means;

said lower end of said tooth being a segment of a curve in lateral cross-section, said forward working end of said tooth being located on said lower end;

said lower end of said tooth is forwardly and upwardly inclined at said forward working end; each of the digging members being arranged in a stair-stepped relationship, with the uppermost digging member being located in advance of the lowermost digging member.

13. The digging tooth of claim 12 wherein each of the digging members are arranged substantially parallel to one another, each digging member terminating in a cutting face.

14. The digging tooth of claim 13 wherein each digging member has a longitudinally extending relief formed therein that reduces the thickness of the member.

15. The digging tooth of claim 8 wherein said digging members each have a longitudinal central axis and a cutting face; the forward end of the tooth together with the forward end of the digging members jointly form a cutting edge; said cutting face of each digging member is in the form of an ellipse formed by a plane passing through the forward end thereof at an oblique angle respective to the longitudinal central axis of the digging member.

16. The digging tooth of claim 15 wherein each digging member is a cone.

17. The digging tooth of claim 16 wherein said lower part of said tooth is a segment of a cone.

18. The digging tooth of claim 17 wherein said cutting face of each digging member extends in advance of an adjacent tooth cutting edge.

19. The digging tooth of claim 18 wherein said tooth cutting edge that is located between the cutting faces of adjacent digging members is a curved surface that slopes rearwardly and inwardly respective to the inside curved surface of said tooth.

* * * * *

UNITED STATES PATENT AND TRADEMARK OFFICE

CERTIFICATE OF CORRECTION

PATENT NO. : 4,776,114

DATED : OCTOBER 11, 1988

INVENTOR(S) : CHARLES W. HEMPHILL, SR., ET AL

It is certified that error appears in the above-identified patent and that said Letters Patent is hereby corrected as shown below:

Column 2, line 61, correct the spelling of "disclosed";

Column 5, line 58, delete "to a" after opposed;

Line 59, insert --and-- after "end".

Column 6, line 44, insert --digging-- before "mem-".

Signed and Sealed this

Seventh Day of March, 1989

*Attest:*

DONALD J. QUIGG

*Attesting Officer*

*Commissioner of Patents and Trademarks*